United States Patent [19]

Cole

[11] Patent Number: 4,697,488

[45] Date of Patent: Oct. 6, 1987

[54] DEVICE FOR SLICING AND STORING FOOD SUCH AS CHEESE AND THE LIKE

[76] Inventor: Gregory B. Cole, 103 Locust, Santa Cruz, Calif. 95060

[21] Appl. No.: 708,018

[22] Filed: Mar. 4, 1985

[51] Int. Cl.[4] ..... B26D 1/547

[52] U.S. Cl. ..... 83/437; 30/116; 83/417; 83/610; 83/651.1

[58] Field of Search ..... 83/417, 423, 437, 589, 83/581.1, 651.1, 610; 30/115, 116, 124

[56] References Cited

U.S. PATENT DOCUMENTS

| | | | |
|---|---|---|---|
| 1,005,128 | 10/1911 | Blain | 83/437 |
| 1,496,494 | 6/1924 | Selvig | 83/651.1 X |
| 1,498,497 | 6/1924 | Way | 30/116 X |
| 1,595,097 | 8/1926 | Howell | 83/651.1 X |
| 1,679,004 | 7/1928 | Pinkel et al. | 30/116 X |
| 2,186,884 | 1/1940 | Shomaker | 83/589 X |
| 2,444,704 | 7/1948 | Keefer | 83/437 |
| 2,580,864 | 1/1952 | Upright | 83/437 X |
| 2,813,336 | 11/1957 | Ackerman | 30/115 |
| 2,814,113 | 11/1957 | Morlacchi | 83/437 |
| 2,871,939 | 2/1959 | Close | 83/589 |
| 4,103,579 | 8/1978 | Rowe | 83/651.1 X |
| 4,196,647 | 4/1980 | Fish | 83/610 X |
| 4,513,501 | 4/1985 | Lee | 30/115 |

OTHER PUBLICATIONS

Miles-Kimball Catalogue, Cut-A-Pat, HK4869, Apr., 1951.

*Primary Examiner*—Frank T. Yost

[57] ABSTRACT

A device for slicing and storing food such as cheese and the like for cutting of said food into slices of any thickness. Said device comprises a carrier with a top, a bottom, two sides, one enclosed end and a closable aperture end. A pusher, integral to the device, is provided for advancing food matter within the carrier toward the aperture end, without handling the food, at which point a spring actuated tensioned wire tool component, integral to the device, mounted on two spaced arms with a cross bar, can be manually pressured across the aperture end to sever said food. Said wire tool coponent returns to the pre-cutting position after each cut by spring action. A door to close the aperture end is provided to allow storage of food matter between cutting function uses.

5 Claims, 10 Drawing Figures

DEVICE FOR SLICING AND STORING FOOD SUCH AS CHEESE AND THE LIKE

BACKGROUND OF THE INVENTION

Cutting and slicing devices of the various types are known to the art by which wire is pressured against food matter to sever it from the food stock. However, the similar prior art devices are subject to certain disadvantages and shortcomings. The major disadvantages lying in the usual need to touch the food matter at each cutting step, to typically require the use of two hands to position and cut the food matter; the requirement to manually retract the cutting device at each cutting step; the shortcoming of not being able to store the food matter within the cutting device between uses thus eliminating the cycle of loading the cutter at each use.

Similar prior art includes U.S. Pat. Nos. 4,103,579; 3,766,817; 1,931,982; 1,796,212 and 1,595,097. U.S. Pat. No. 4,103,579 is dissimilar because it utilizes a wire cutter which is in compression, does not act in a storage function, does not return the cutting tool to pre-cutting position by spring tension and appears to require two hands to advance and cut the food matter. U.S. Pat. No. 3,766,817 is dissimilar in that it does not serve a storage function, it does not have a means integral to the device to advance the food matter toward the cutting tool without handling the food matter, it does not have a spring actuated return mechanism bringing the cutting tool back to a pre-cutting position. U.S. Pat. No. 1,595,097 provides the storage function but does not include a spring actuated return mechanism bringing the cutting tool back to a pre-cutting position and does not have a tensioned wire mounted upon two spaced arms with a cross bar.

Each of the similar prior art searched has disadvantages to the improved construction of the present invention.

DETAILED DESCRIPTION OF THE ILLUSTRATED EMBODIMENT

Embodiment 1

Figure 1:
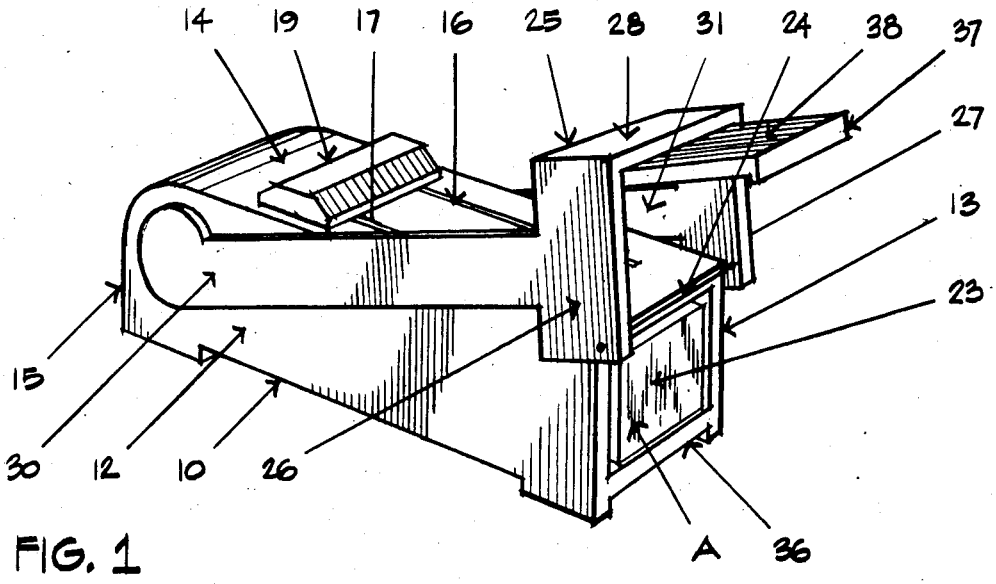
FIG. 1 is a perspective representation of a slicing device constituting one embodiment of the invention and having its arcuately acting cutting component and door in a pre-cutting position.
Figure 2:
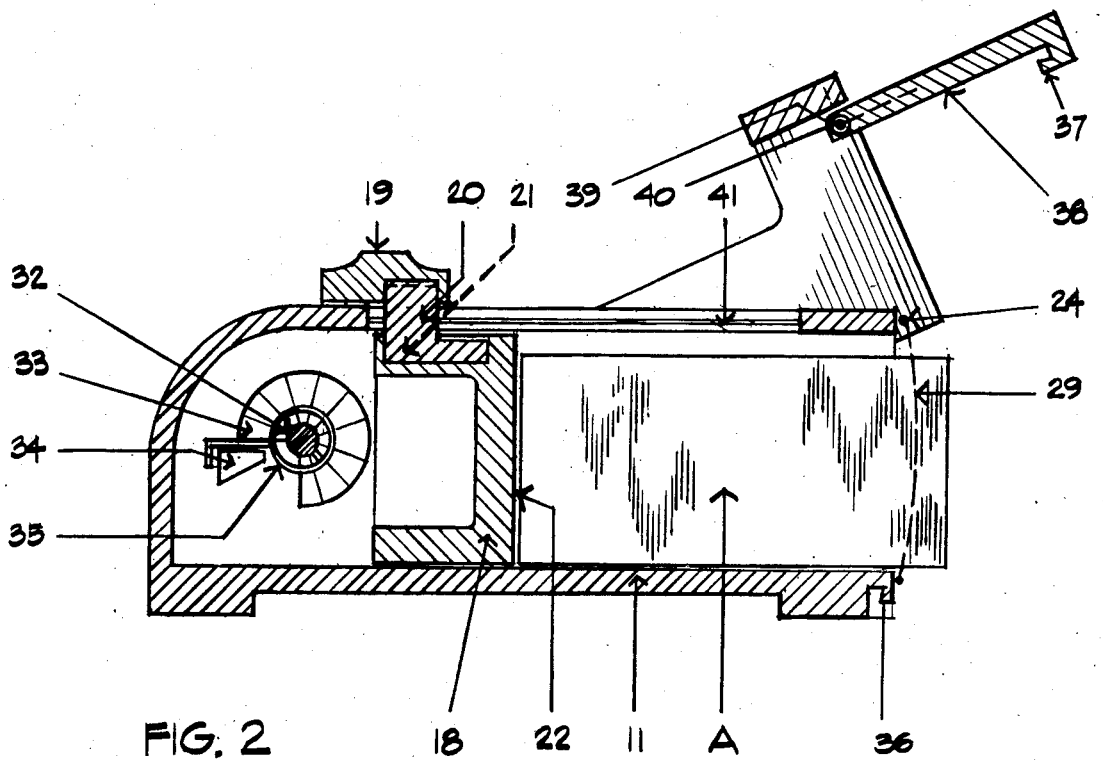
FIG. 2 is a linear cross-section through one embodiment of a slicing device which shows various parts thereof in a pre-cutting position.
Figure 3:
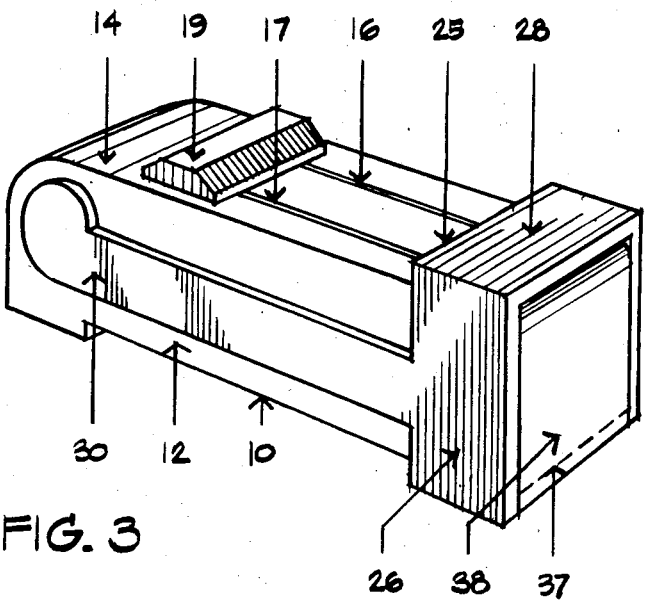
FIG. 3 is a perspective representation of a slicing device constituting one embodiment of the invention and having its arcuately acting cutting component and door in the storage position.
Figure 4:
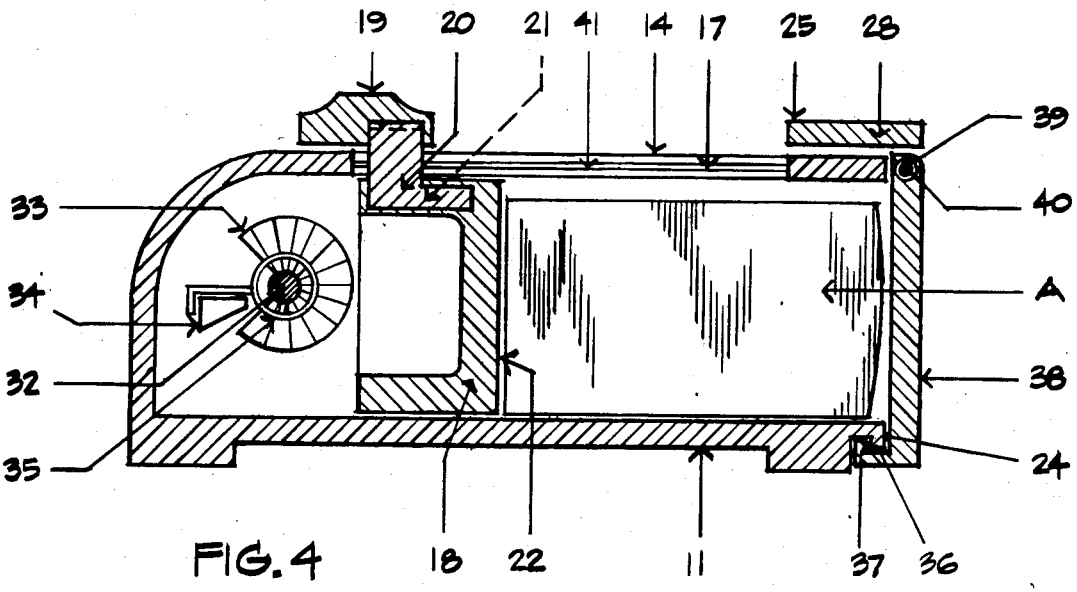
FIG. 4 is a linear cross-section through one embodiment of the device which shows various parts thereof in the storage position.

Referring to the drawings, FIGS. 1, 2, 3, 4 in detail, the device for slicing and storing food such as cheese A includes the carrier 10 which has a bottom 11 side walls 12 and and 13 attached rigidly to the top 14 and the end 15 forming a rigid five-sided enclosure. The top 14 of the carrier 10 has two slots 16 and 17 which serve as guides to advance the food pusher 18 in a rectilinear path within the carrier 10. The food pusher 18 is connected to the thumb pusher 19 by two guide flanges 20 and 21. Food pusher 18 is slightly smaller than the carrier 10 inside dimensions so there will be no tendency for food pusher 18 to seize up. Thumb pusher 19 is mounted behind food pusher 18 to enable the pushing plane 22 to extend to or beyond the aperture end 23 thus pushing the cheese A fully out of the carrier 10. Aperture end 23 provides a flush opening to enable wire tool 24 to pass by the interior walls of carrier 10 thus completely severing the cut cheese from the cheese A.

The wire tool component 25 consists of two spaced arms 26 and 27 supported by a cross bar 28 which hold a tensioned wire tool 24 which cuts in an arcuate path 29 across the aperture end 23 of the carrier 10. The wire tool component further consists of two radially extending arms 30 and 31 mounted on axle 32. Axle 32 is mounted through carrier 10 allowing it to rotate in a restricted path, the top of which stops the wire tool 24 upward motion at a point directly above the cheese A at the aperture end 23. Said upward motion is arrested by axle extension 33 engaging abutment 34. An axial wire spring 35 pressuring against abutment 34 causes upward pressure on the wire tool component 25 holding it in position for advancement of cheese A prior to the cutting function. Axial wire spring 35 also causes upward pressure which engages carrier lip 36 with aperture door lip 37 thus holding it in position with the aperture end door 38 closed over the aperture opening for storage. Application of pressure on cross bar 28 with aperture end door 38 in closed position, releases carrier lip 36 from aperture end door lip 37 allowing door axial wire spring 39 to swing open the aperture end door 38 about door axle 40. Said aperture door 38 abuts the bottom edge of cross bar 28 to restrain it in a right angled open position during slicing functions. Wire tool 24 is protected and enclosed within aperture door 38 in the storage function position of the wire tool component 25.

In open position, cheese A or the like can be cut at any length by applying lateral pressure to thumb pusher 19 until the desired amount extends beyond the end of the aperture end 23 at which point pressure is applied to the cross bar 28 bringing the wire tool 24 in contact with and through the cheese A. The severed cheese then falls free of the carrier 10 and cheese A.

The thumb pusher 19 may be removable along with guide flanges 20 and 21 from food pusher 18 to enable interior cleansing of the device. Slots 16 and 17 may be fitted with linear gaskets 41 to limit air infiltration to stored foods and food pusher 18 may be designed to be spring actuated with a sequenced advance mechanism to provide for repeated equal sized foodmatter slicing.

Embodiment 2

Figure 5:
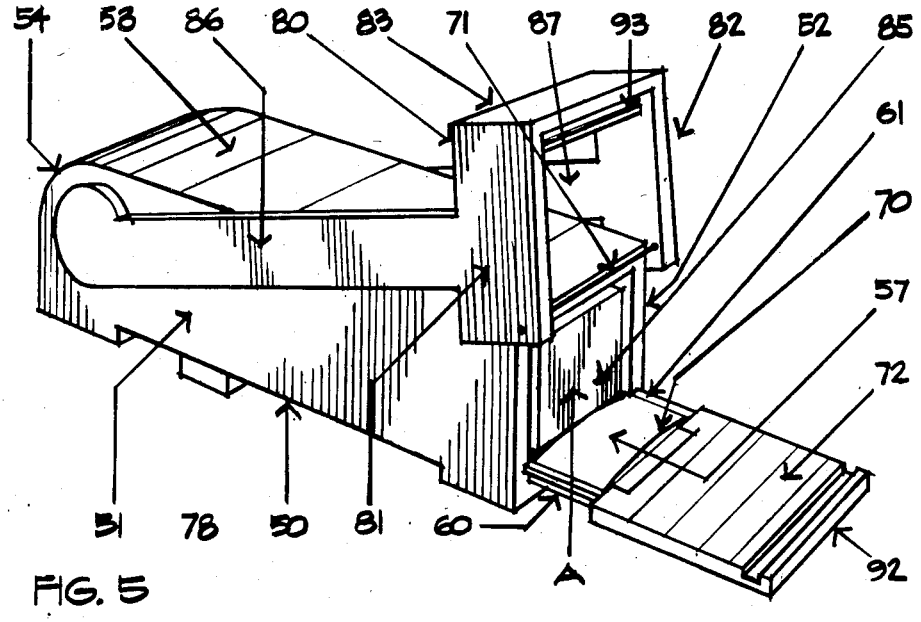
FIG. 5 is a perspective representation of a slicing device constituting a second embodiment of the invention and having its arcuately acting cutting component, pallet and pallet door in the pre-cutting position.
Figure 6:
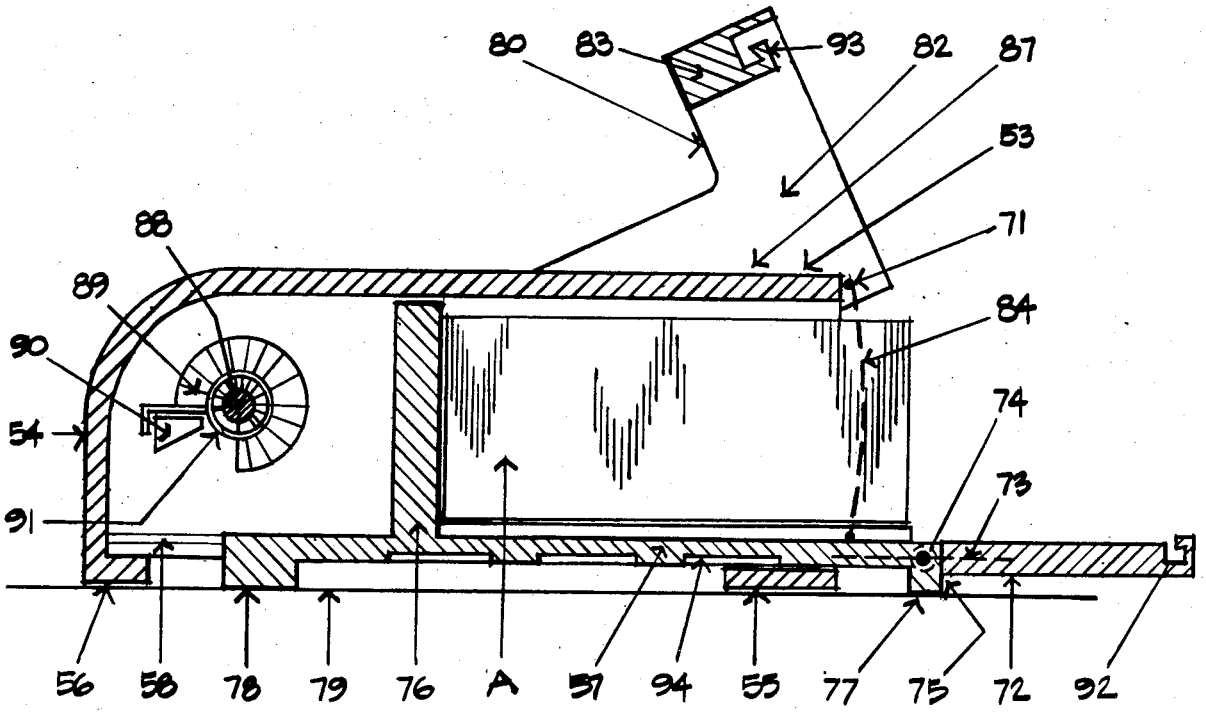
FIG. 6 is a linear cross-section through a second embodiment of a slicing device which shows various parts thereof in a pre-cutting position.
Figure 7:
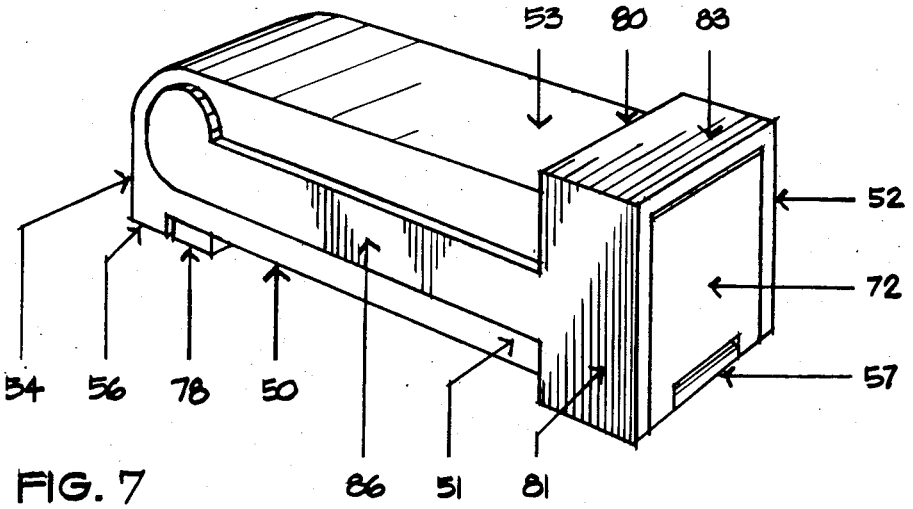
FIG. 7 is a perspective representation of a slicing device constituting a second embodiment of the invention and having its arcuately acting cutting component, pallet and pallet door in the storage position.
Figure 8:
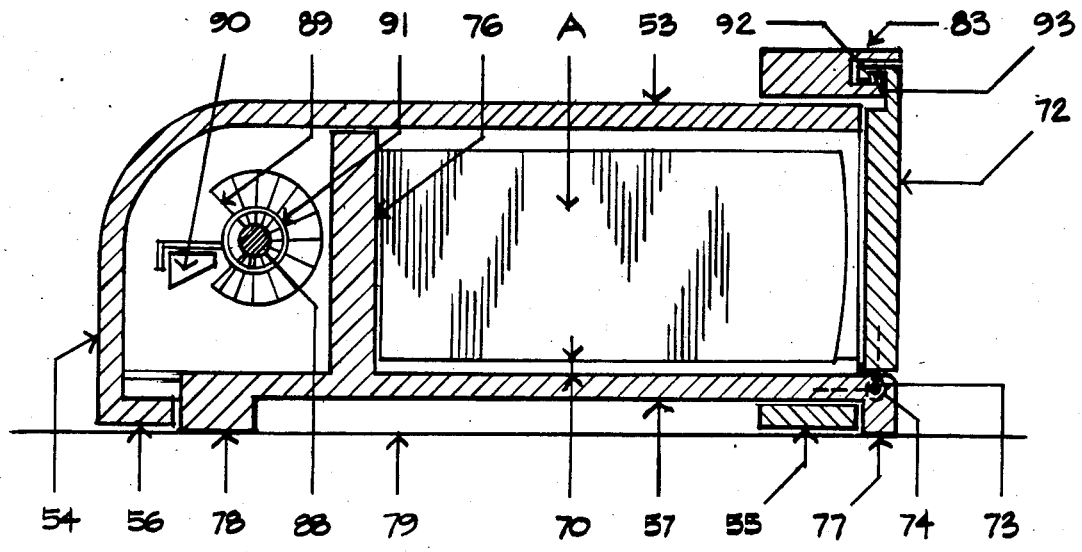
FIG. 8 is a linear cross-section through a second embodiment of a slicing device which shows various parts thereof in a storage position.
Figure 9:
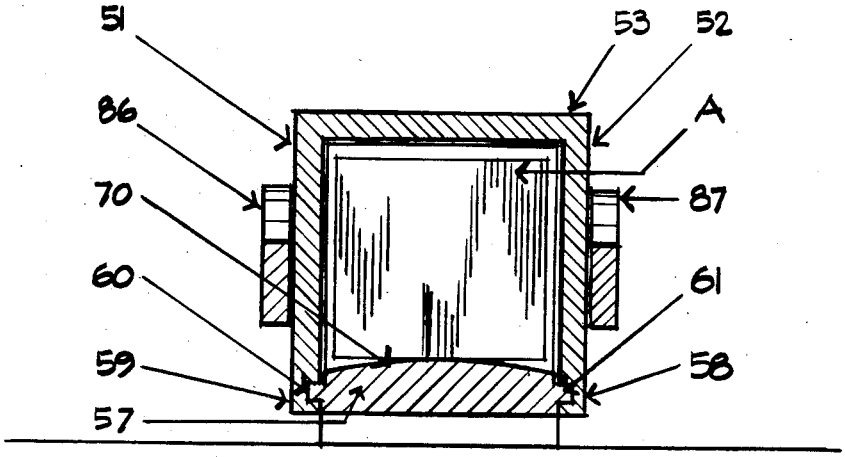
FIG. 9 is a cross-section of a second embodiment of the device showing convex pallet and guides thereof.
Figure 10:
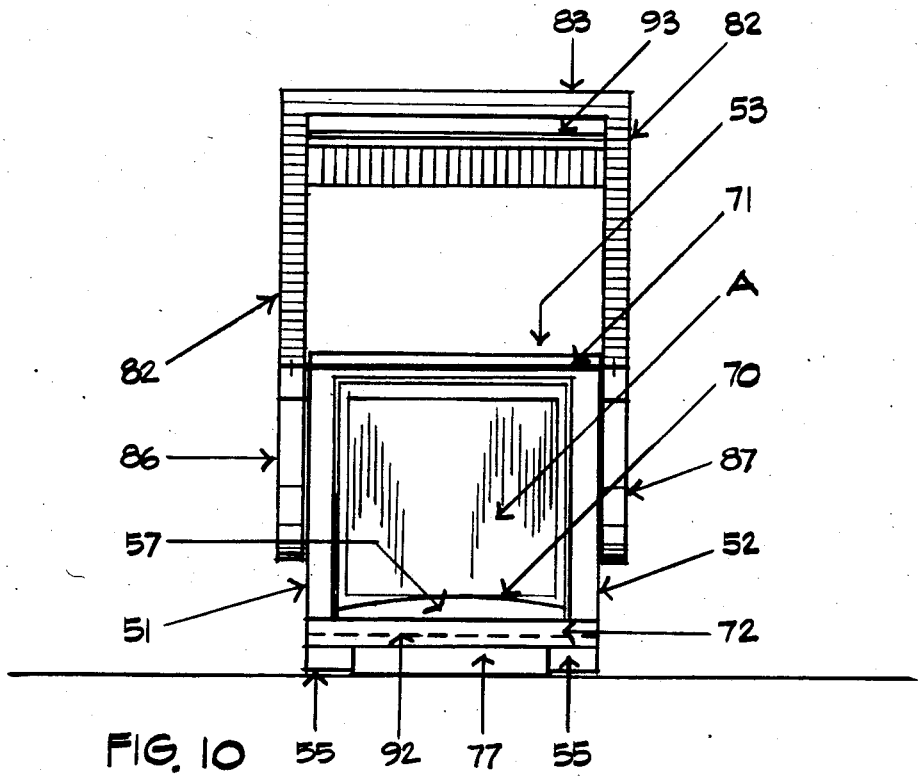
FIG. 10 is an end elevation of a second embodiment of a slicing device which shows various parts thereof including the convex pallet.

Referring to the drawings and specifications FIGS. 5, 6, 7, 8, 9, 10 in detail, the device for slicing and storing food such as cheese A includes the carrier 50 which has side walls 51 and 52 attached rigidly to the top 53, the end 54 the bottom front cross member 55 and the bottom back cross member 56 forming a rigid structure. A slideable pallet 57 fits within channel guides 58 and 59 of the carrier 50 mounted on two flanges 60 and 61 of said slideable pallet 57. The upper surface of said pallet 57 is convex upward 70 in a shape approximating the tensioned wire tool 71 as it passes through the cheese A thereby causing complete severing of said food matter. Aperture end door 72 mounted on slideable pallet 57 by axial spring 73 actuated axle 74 is restrained in open position by contact with outer edge 75 and axial spring 73 pressure. Food pusher 76 is mounted on slideable pallet 57, front pallet foot 77 and back pallet foot 78 extend slightly below bottom front cross member 55 and bottom back cross member 56 to enable one handed operation while device rests on table 79 by sliding the carrier 50 while the slideable pallet 57 remains stationary due to pressure on table.

The wire tool component 80 consists of two spaced arms 81 and 82 supported by a cross bar 83 which hold a tensioned wire tool 71 which cuts an arcuate path 84 across the aperture end 85 of the carrier 50. The wire tool component 80 further consists of two radially extending arms 86 and 87 mounted on axle 88. Axle 88 is mounted through carrier 50 allowing it to rotate in a restricted path the top of which stops the wire tool 71 upward motion at a point directly above the cheese A at the aperture end 85. Said upward motion is arrested by axle extension 89 engaging abutment 90. Axial wire spring 91 pressuring against abutment 90 causes upward pressure on wire tool component 80 holding it in position for advancement of cheese A prior to cutting function. Axial wire spring 91 also causes upward pressure which engages pallet door lip 92 with cross bar lip 93 thus holding it in position with the aperture end door 72 closed over the aperture opening for storage. Application of pressure on cross bar 83 with aperture end door 72 in closed position releases cross bar lip 93 from aperture end door lip 92 allowing door axial wire spring 73 to swing open aperture end door 72 about door axle 74. Wire tool 71 is protected and enclosed within aperture door 72 in the storage function of the wire tool component 80.

In open position, Cheese A or like can be cut at any length by applying lateral pressure to pallet underside finger holes 94 until the desired amount extends beyond the opening of aperture end 85 at which point pressure is applied to cross bar 83 bringing wire tool 71 in contact with and through the cheese A.

The invention provides, therefore, an improved slicing device for storing and dispensing cheese and the like. It is relatively simple to construct, and it may be sold at relatively low price. The device may be constructed of plastic and metal to be strong and durable. It provides dual functions of storage and slicing. The slicing function may be accomplished with one hand and random lengths may be cut off of the food stock. Embodiment 1 allows the sliced food matter to fall free from the food stock and the cutting device thereby allowing it to be dispensed directly without an intermediate transferance step. Embodiment 2 allows the food stock to remain on the pallet in cut or uncut form.

It will be appreciated that while a particular embodiment of the invention has been shown and described, modification may be made. It is intended in the following claims to cover all such modifications which come within the spirit and scope of the invention.

SUMMARY OF THE INVENTION

The invention provides the functions of slicing and storage of cheese and food of like matter. The carrier consists of a bottom two sides, a closed end, a top and an aperture end which is closable. The carrier primary function is to enclose, and thereby provide storage for, the food matter between uses of the cutting device. A means to advance said food matter, without touching it, toward the cutter path is included within the carrier. Two such means are described under Species 2 and Species 3 herein. The advantage of having a pusher within the carrier is the avoidance of handling the food each time the cutter is used. The spring actuated, tensioned wire tool mounted integrally on the carrier allows cyclical operation without having to pull the wire tool back up to its original position manually. On small versions of the invention the entire operation of advancement and cutting can be done with one hand.

SPECIES 1 SUMMARY OF THE INVENTION

All elements of the general summary of the invention, additionally in this species a manually operable, spring loaded, arcuately acting, axially mounted wire tool component is activated by manual pressure on the cross bar which when pushed applies radial severing force to the food matter by the wire tool. The axle mounted spring provides radial force around the radius centerpoint causing the wire tool to return to original position upon release of cutting pressure.

SPECIES 2 SUMMARY OF THE INVENTION

All elements of Species 1 of the invention additionally: a hinged door which encloses the uncut food matter for storage by closing manually over the end aperture of the carrier is mounted between the spaced legs with the hinge point adjacent to the cross bar. Said door being spring activated to the spring loaded manual pressure bar of the arcuately acting wire tool component thereby disengaging a restraining catch allowing the door to open. A feature of the invention is that the aperture end is flush cut allowing the wire tool to pass beyond all edges of the food stock which, when severed, is unsupported allowing it to free fall from the carrier and the food stock thus eliminating the step of transference. The means of advancing the food matter consists of a pusher assembly wherein a thumb pusher exterior to the carrier advances a food pusher interior to the carrier along slotted guides in the carrier. A flange or flanges slide within said slotted guides and interconnect the thumb pusher with the food pusher. The pusher surface which contacts the food matter is positioned such that it can extend to or slightly beyond the flush cut aperture end thereby extending the food beyond the carrier aperture end.

SPECIES 3 SUMMARY OF THE INVENTION

All elements of species 1 of the invention additionally: a slideable pallet bottom for said carrier with longitudinal flanges slideably mounted in channels of said spaced sidewalls with a convex top surface on said pallet to match the approximate tensioned wire configuration as it passes through the food matter. This feature allows complete severance of the food matter by bringing the wire tool in contact with the pallet across its full width. Pallet access through carrier bottom allows movement of pallet within carrier by pressure applied laterally thereto. A spring activated aperture end door mounted on said pallet with a spring tension retained locking catch engaging the aperture end door lip with the upper cross bar.

Having described the invention, what is claimed as new and desired to be secured by letters of patent is:

1. A device for slicing and storing a block of cheese and like food matter comprising a. a carrier having b. a bottom, two spaced side walls extended up therefrom, an end and a top, said carrier having an open aperture end, c. means for advancing the food matter through the aperture end, d. a cutting tool component consisting of a wire cutting tool mounted between two spaced legs projecting out from an integral cross bar movably mounted on and integral with the carrier such that the wire cutting tool passes across (of) the aperture end, e. means resiliently urging said cutting tool component to an inoperative position, f. a door mounted about an axial centerline whereby the aperature end is closed, g. said door being mounted on the two spaced legs and crossbar of the cutting tool component, h. resilient means urging said door to open position i. Resilient means urging said door to engage a locking catch to restrain said door in a closed position, j. a (slideable) food pusher contained within said carrier.

2. A device for slicing and storing a block of cheese and like food matter comprising a carrier for the food matter having an open end, a door arranged to cover the open end of said carrier, means resiliently urging said door to an open position, means releasably holding said door in a closed position, manually operable means to release said door holding means, means for advancing the food matter through the open end, a food cutting tool mounted for movement through food matter adjacent the open end of said carrier, means resiliently urging said cutting tool to an inoperative position, manually operable means to move said cutting tool through the food matter, said means releasably holding said door in a closed position includes means resiliently urging said cutting tool to an inoperative position.

3. A device for slicing and storing a block of cheese and like food matter comprising a carrier for the food matter having an open end, a door arranged to cover the open end of said carrier, means resiliently urging said door to an open position, means for releasably holding said door in a closed position, manually operable means to release said door holding means, means for advancing the food matter through the open end, a food cutting tool mounted for movement through food matter adjacent the open end of said carrier, manually operable means to move said cutting tool through the food matter, said manually-operable means includes a single manually-engageable element for both releasing said door holding means and moving said cutting tool through food matter.

4. A device for slicing and storing a block of cheese and like food matter comprising, a carrier for the food matter having an open end, a door arranged to cover the open end of said carrier, means resiliently urging said door to an open position, means releasably holding said door in a closed position, manually operable means to release said door holding means, a pallet supporting the food matter providing for movement through the open end of the carrier, a cutting tool arranged to pass across the open end of said carrier to cut the food matter, means resiliently urging said cutting tool to an inoperative position at one side of the open end of said carrier, means for advancing said food matter through the open end, and means for releasably holding said door in a closed position includes means resiliently urging said cutting tool to an inoperative position.

5. A device for slicing and storing a block of cheese and like food matter comprising, a carrier for the food matter having an open end, a door arranged to cover the open end of said carrier, means resiliently urging said door to an open position, means releasably holding said door in a closed position, a pallet supporting the food matter providing for movement through the open end of the carrier, a cutting tool arranged to pass across the open end of said carrier to cut the food matter, means resiliently urging said cutting tool to an inoperative position at one side of the open end of said carrier, means for advancing said food matter through the open end, and a single manually engageable element for both releasing said door holding means and moving said cutting tool through food matter.

* * * * *